US007325468B1

(12) United States Patent
Chen

(10) Patent No.: US 7,325,468 B1
(45) Date of Patent: Feb. 5, 2008

(54) HOLLOWED SOCKET

(75) Inventor: Tsung-Da Lin Chen, Taichung (TW)

(73) Assignees: Jing-Jie Lin, South District, Taichung (TW); Yao-Ling Jhno, South District, Taichung (TW)

( * ) Notice: Subject to any disclaimer, the term of this patent is extended or adjusted under 35 U.S.C. 154(b) by 0 days.

(21) Appl. No.: 11/639,055

(22) Filed: Dec. 15, 2006

(51) Int. Cl.
*B25B 13/06* (2006.01)
*B25B 23/00* (2006.01)

(52) U.S. Cl. ..... 81/121.1; 81/125; 81/177.85

(58) Field of Classification Search ..... 81/121.1, 81/124.3, 124.4, 124.5, 125, 177.85, 185
See application file for complete search history.

(56) References Cited

U.S. PATENT DOCUMENTS 460,474 A * 9/1891 Knapp et al. ..... 81/63
603,377 A * 5/1898 Fitch ..... 81/63
2,110,397 A * 3/1938 Kangas ..... 403/326
2,811,883 A * 11/1957 Cleaves ..... 81/124.1
3,222,959 A * 12/1965 Clark ..... 81/124.6
3,376,765 A * 4/1968 Ruby ..... 81/124.6
3,630,107 A * 12/1971 Carr ..... 81/125
4,602,534 A * 7/1986 Moetteli ..... 81/177.85
5,477,758 A * 12/1995 Cunningham ..... 81/177.85
5,481,949 A * 1/1996 Yen ..... 81/438

* cited by examiner

*Primary Examiner*—David B Thomas

(57) ABSTRACT

A hollowed socket comprises a driving portion and an engaging portion; an outer side of the driving portion having a receiving groove; an elastic sheet being installed in the receiving groove; and a free end of the elastic sheet having a positioning block. An inner space of the driving portion is communicated to the receiving groove. The elastic sheet has a shape like "8" and one end of the elastic sheet is a fixing end which is fixed to the receiving groove. The elastic sheet is fixed to the receiving groove by using a fixing unit. The elastic sheet is tightly engaged to the receiving groove. An inner space of the driving portion is communicated to an inner space of the engaging portion.

5 Claims, 5 Drawing Sheets

HOLLOWED SOCKET

FIELD OF THE INVENTION

The present invention relates to sockets, and particularly to a hollowed socket without using steel ball so that the assembly work can be performed easily. The elastic sheet is installed at an outer side of the socket. It will not interfere an inner space of a driving portion. When it is desired to drive an object with a long body. The rod body of the object can pass through the inner space of the socket without affecting the elastic sheet and thus it is not pushed out by the rod body.

BACKGROUND OF THE INVENTION

A hollowed socket is used with a spanner to drive a screw object. The spanner may be an open-end spanner or a ring spanner. The spanner is formed with a hexagonal driving portion. The driving portion is formed with a receiving groove which is communicated to an inner space of the driving portion. A steel ball is received in the driving portion. An inner space of the driving portion is installed with an annular elastic sheet which resists against the steel ball so that the elastic sheet can resist against the spanner for driving a screw object.

However, the annular elastic sheet in the inner space of the driving portion will occupy a volume in the inner space. If the socket is used to drive a long screw object, the nut must be locked to a long screw rod and the screw rod passes through the inner space of the driving portion. However, the elastic sheet will be extruded to fall out. Thus the hollowed socket can not work. As a whole, the prior art design is not practical and needed to be improved.

SUMMARY OF THE INVENTION

Accordingly, the primary object of the present invention is to provide a hollowed socket without using steel ball so that the assembly work can be performed easily. The elastic sheet is installed at an outer side of the socket so that it will not interfere an inner space of a driving portion. When it is desired to drive an object with a long body. The rod body of the object can pass through the inner space of the socket without affecting the elastic sheet and thus it is not pushed out by the rod body.

To achieve above objects, the present invention provides a hollowed socket comprising a driving portion and an engaging portion; an outer side of the driving portion having a receiving groove; an elastic sheet being installed in the receiving groove; and a free end of the elastic sheet having a positioning block. An inner space of the driving portion is communicated to the receiving groove. The elastic sheet has a shape like "8" and one end of the elastic sheet is a fixing end which is fixed to the receiving groove. The elastic sheet is fixed to the receiving groove by using a fixing unit. The elastic sheet is tightly engaged to the receiving groove. An inner space of the driving portion is communicated to an inner space of the engaging portion.

The various objects and advantages of the present invention will be more readily understood from the following detailed description when read in conjunction with the appended drawing.

DETAILED DESCRIPTION OF THE INVENTION

Figure 1:
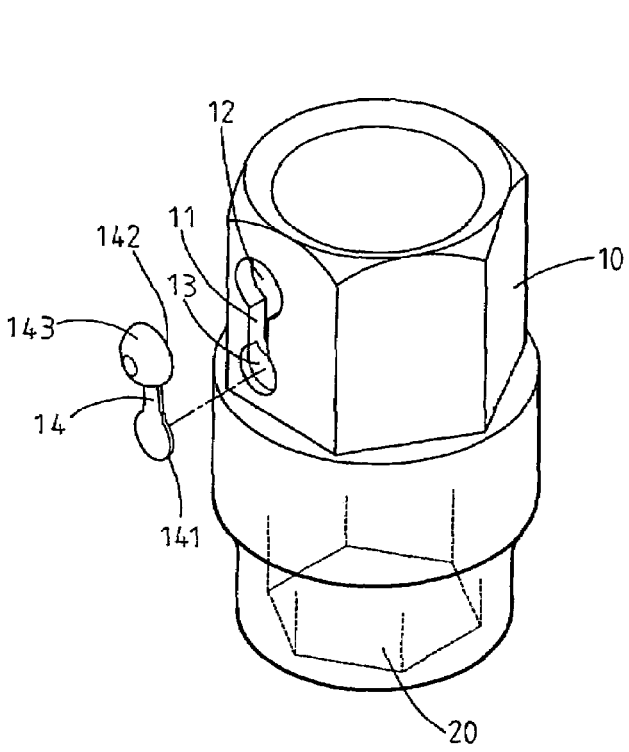
FIG. 1 is a structural exploded perspective view of the hollowed socket of the present invention.
Figure 2:
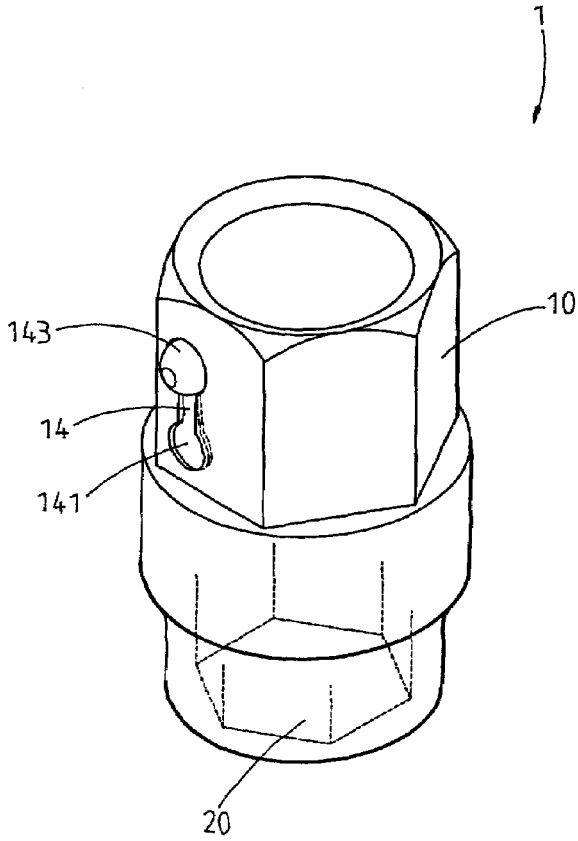
FIG. 2 is a perspective view of the hollowed socket of the present invention.
Figure 3:
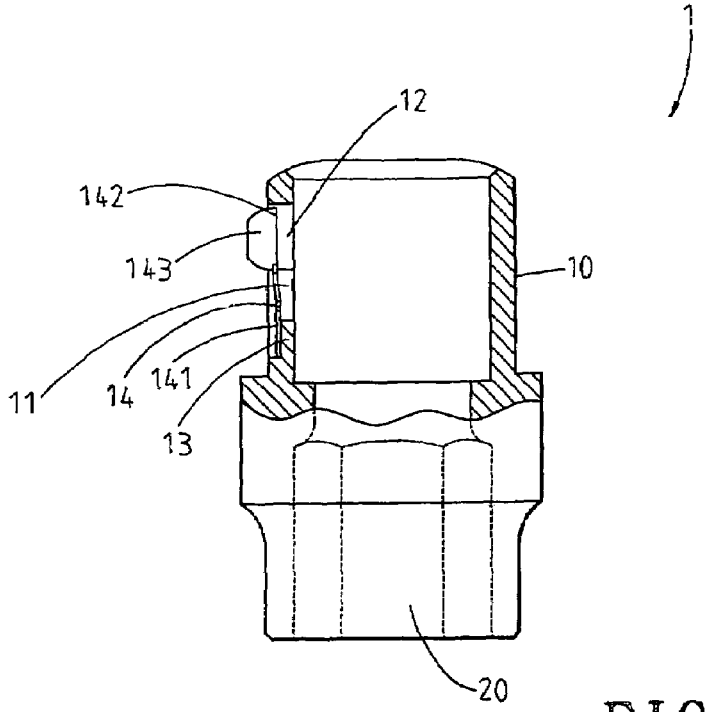
FIG. 3 is a schematic cross sectional view of the hollowed socket of the present invention.
Figure 4:
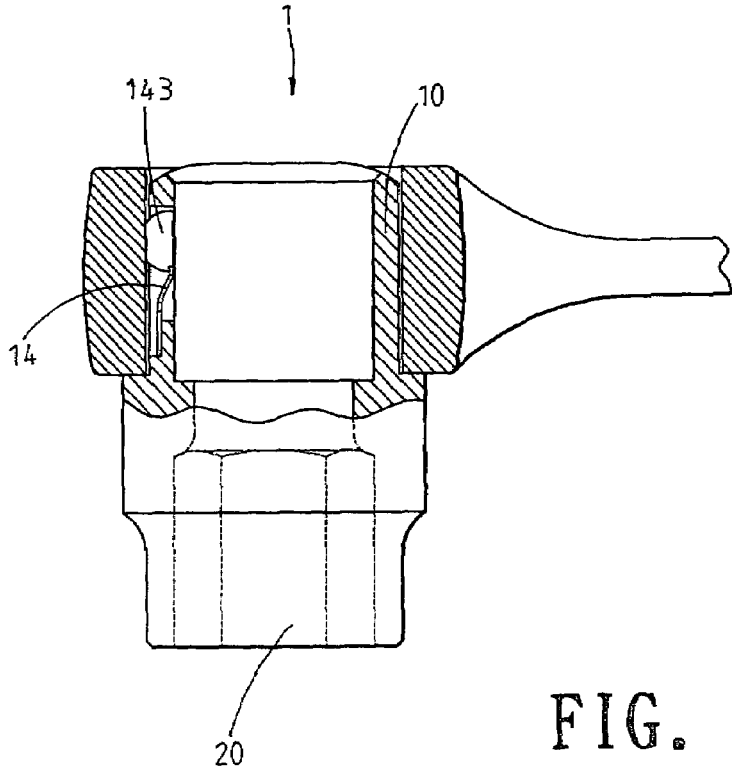
FIG. 4 is a schematic cross sectional view showing the use of the hollowed socket of the present invention, which is used with a spanner.
Figure 5:
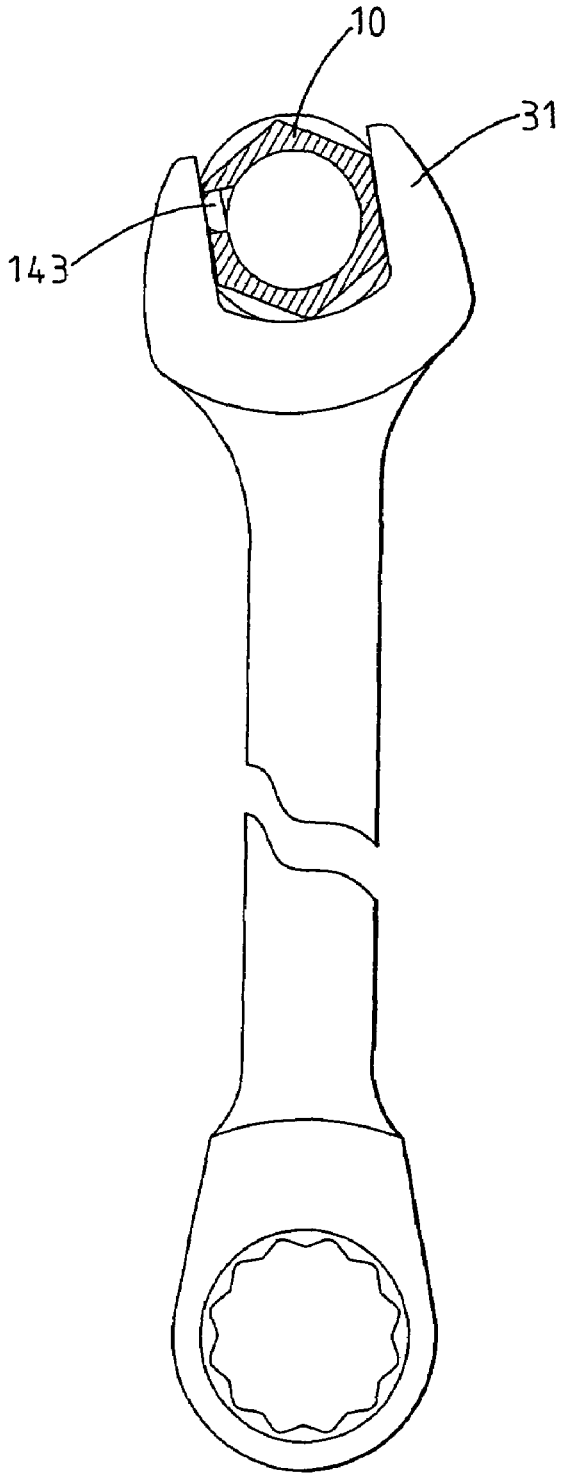
FIGS. 5 and 6 are schematic views showing the use of the hollowed socket of the present invention, which is used with spanners of various forms.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 4, the structure of the present invention is illustrated. The present invention has a driving portion 10 with a polygonal outer shape and an engaging portion 20 with a polygonal inner shape. In the present invention, the driving portion 10 is at an upper end of a body 1 and the elastic sheet 14 is at a lower end of the body 1. However, the driving portion 10 and engaging portion 20 may be at the same side.

An inner space of the driving portion 10 is communicated to an inner space of the engaging portion 20. An outer side of the driving portion 10 is hexagonal. The driving portion 10 can be engaged with a spanner. An outer side of the driving portion 10 has a receiving groove 11 which has an approximate 8 shape. An upper half of the receiving groove 11 is a through hole 12 which is communicated to the inner space of the driving portion 10. Other portion of the receiving groove 11 is a recess 13 which do not penetrating into the inner space of the driving portion 10.

An elastic sheet 14 is installed in the receiving groove 11. The elastic sheet 14 has a fixing end 141 and a free end 142. The fixing end 141 is tightly engaged into the recess 13 of the receiving groove 11 so that the elastic sheet 14 is assembled to the receiving groove 11. The free end 142 is at the through hole 12 of the receiving groove 11. A positioning block 143 protrudes from the free end 142 so as to position a spanner installed to the driving portion 10 to prevent the spanner from sliding out.

The engaging portion 20 has a hexagonal inner space. The engaging portion 20 serves to engage with a screw object. The inner space of the engaging portion 20 is communicated to the inner space of the driving portion 10 so that a long tool can be inserted into the socket of the present invention.

Figure 6:
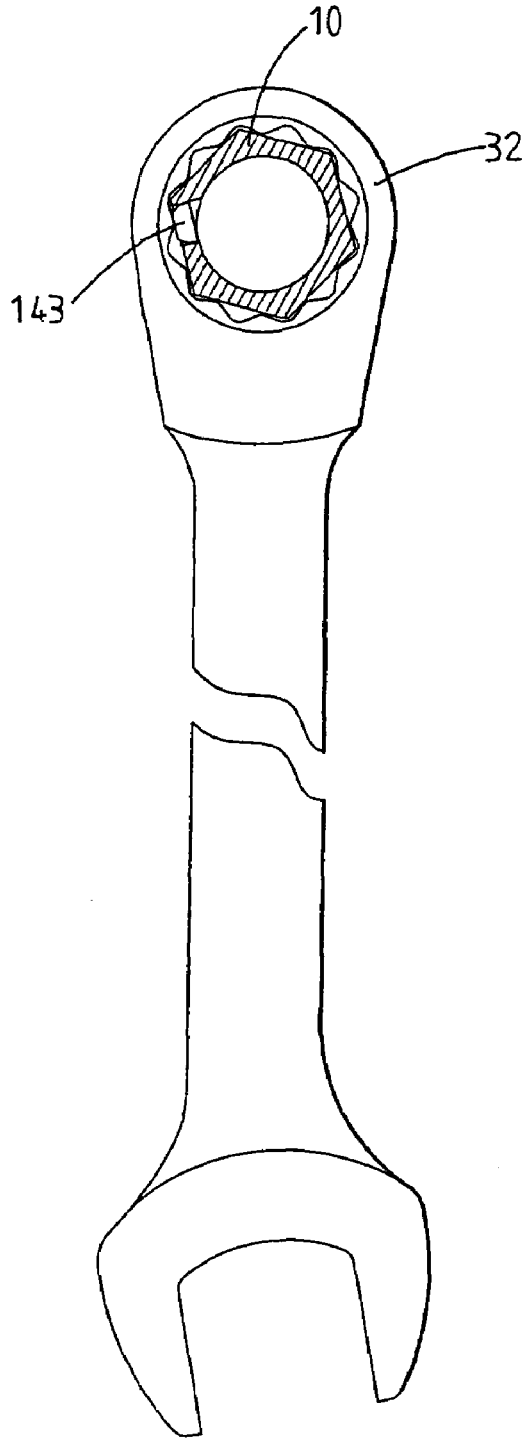

Referring to FIGS. 4 to 7, in use of the present invention, other than socket spanner, the body 1 can be used with a spanner of other forms. The positioning block 143 of the elastic sheet 14 is compressed by a driving head 31 of a spanner so as to enhance the engagement connected the driving portion 10 of the body 1 and the driving head 31. Thus the spanner is prevented from sliding out in operation. Referring to FIG. 6, the driving portion 10 of the driving portion 10 can be used with a ring driving head 32 (or a ratchet driving head). Similarly, the positioning block 143 of the driving portion 10 is compressed by the ring driving head 32 to prevent the spanner to slide out.

Figure 7:
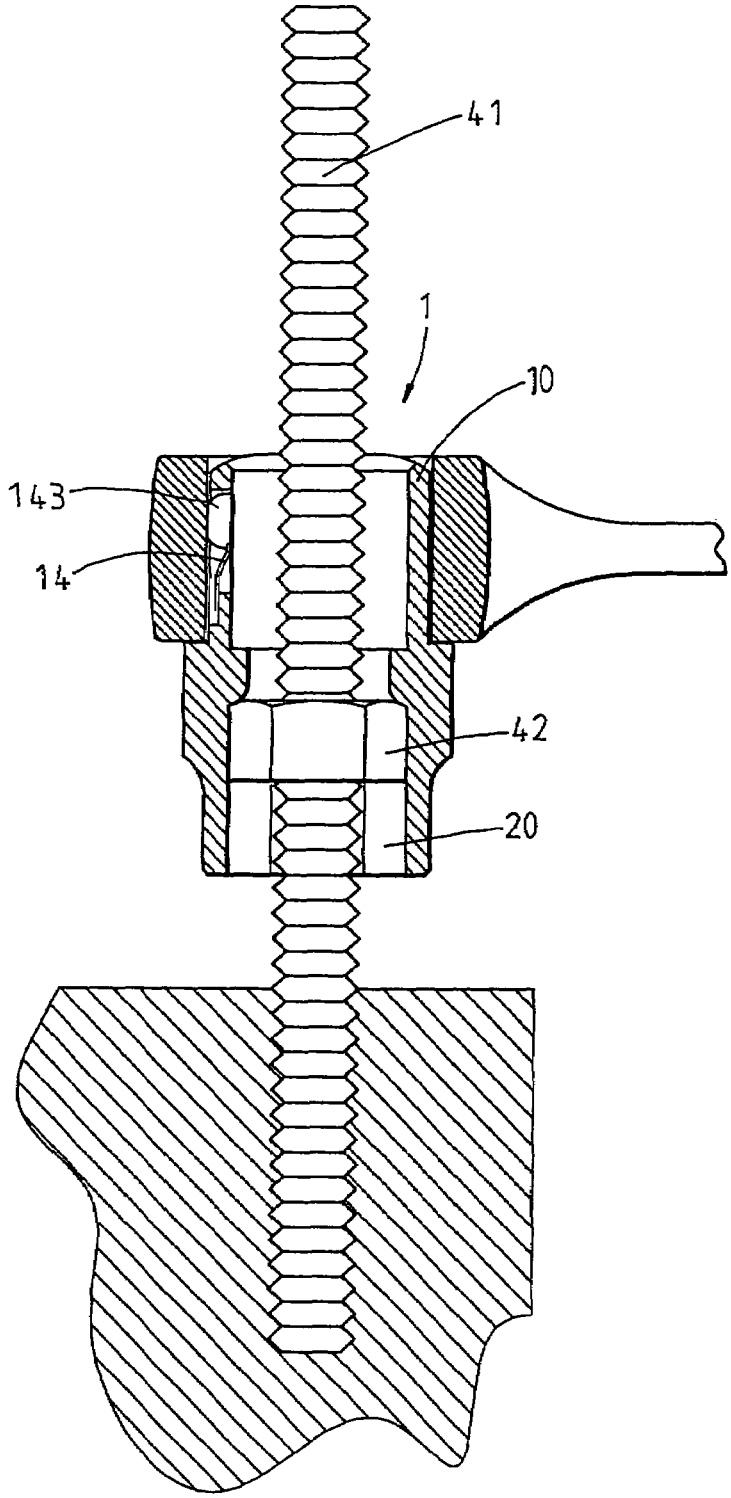
FIG. 7 is a schematic cross sectional view showing that the hollowed socket of the present invention is used with a screw object with a long rod body.

Referring to FIG. 7, when the body 1 of the present invention is applied to a work piece with a rod body 41. The engaging portion 20 is engaged with a nut 42. Because the inner space of the driving portion 10 is communicated to the inner space of the engaging portion 20, the rod body 41 passes out of the driving portion 10 so that the user can screw into or out the nut 42. Moreover, the installation of the driving portion 10 and elastic sheet 14 will not affect the inner space of the driving portion 10. Thus the elastic sheet 14 will not be pushed by the rod body 41. Thereby the lifetime of the product is prolonged and the operation is convenient.

Figure 8:
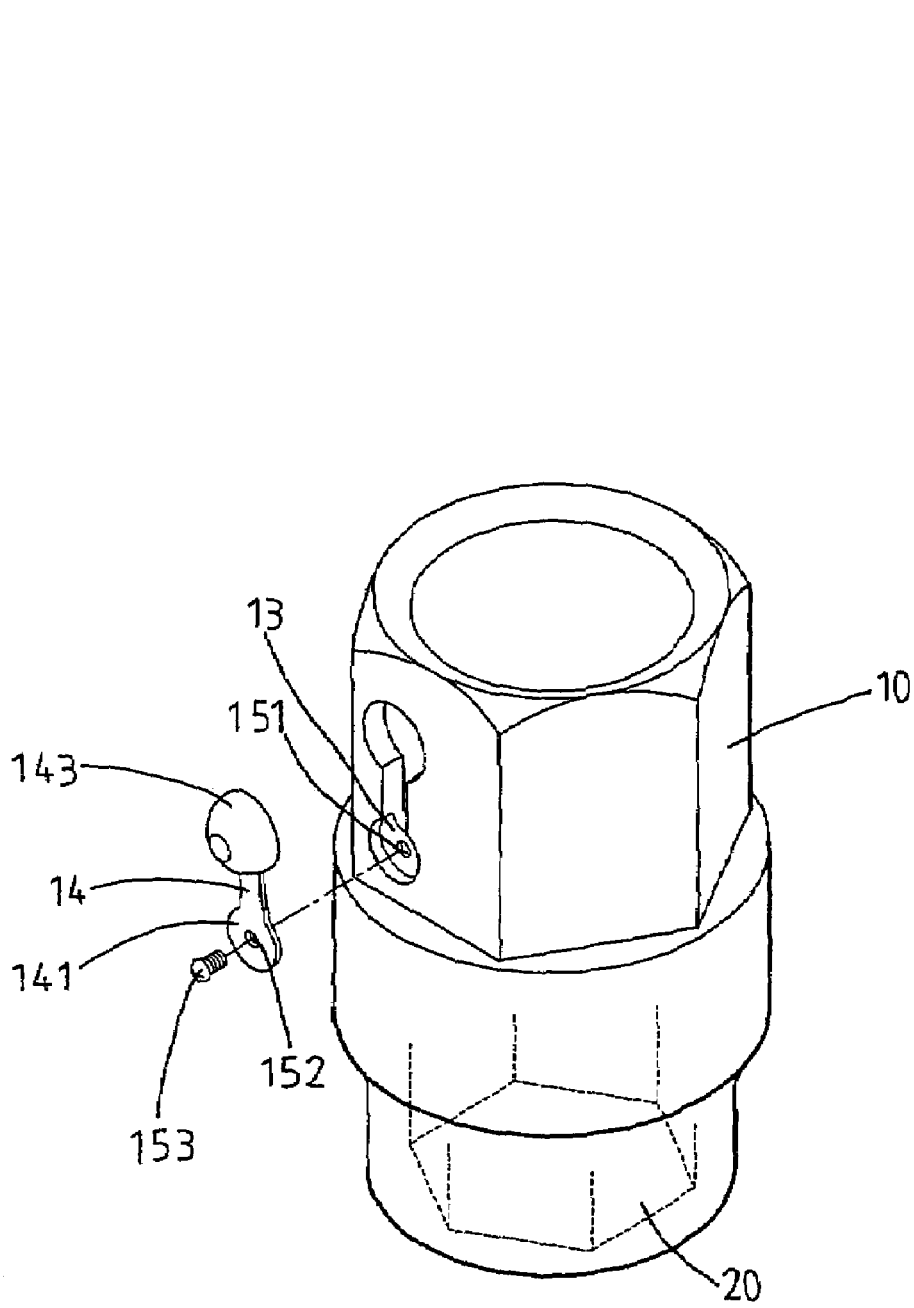
FIG. 8 is an exploded view showing the second embodiment of the present invention.

Referring to FIG. 8, the second embodiment of the present invention is illustrated. In this embodiment, those identical to the above mentioned embodiment will not be further described herein. Only those difference are disclosed.

To enhancing the combination strength connected the elastic sheet 14 and the receiving groove 11 of the driving portion 10, a screwed hole 151 is formed on the recess 13 of the receiving groove 11, and the fixing end 141 of the elastic sheet 14 is formed with a through hole 152. A retainer 153 passes through the through hole 152 to be screwed into the screwed hole 151 so as to fix the elastic sheet 14 to the receiving groove 11. The retainer 153 may be a screw.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hollowed socket comprising a driving portion and an engaging portion; an outer side of the driving portion having a receiving groove; an elastic sheet being installed in the receiving groove; and a free end of the elastic sheet having a positioning block; and wherein the elastic sheet has a shape like "8" and one end of the elastic sheet is a fixing end which is fixed to the receiving groove.

2. The hollowed socket as claimed in claim 1, wherein the elastic sheet is fixed to the receiving groove by using a fixing unit.

3. The hollowed socket as claimed in claim 1, wherein the elastic sheet is tightly engaged to the receiving groove.

4. The hollowed socket as claimed in claim 1, wherein an inner space of the driving portion is communicated to an inner space of the engaging portion.

5. A hollowed socket comprising a driving portion with a polygonal outer shape and an engaging portion with a polygonal inner shape;

an inner space of the driving portion being communicated to an inner space of the engaging portion; an outer side of the driving portion being hexagonal; the driving portion being engaged with a spanner; an outer side of the driving portion having a receiving groove which has an approximate 8 shape; an upper half of the receiving groove having a through hole which is communicated to the inner space of the driving portion; other portion of the receiving groove being a recess which do not penetrating into the inner space of the driving portion;

an elastic sheet installed in the receiving groove; the elastic sheet having a fixing end and a free end; the fixing end being tightly engaged into the recess of the receiving groove so that the elastic sheet being assembled to the receiving groove; the free end being at the through hole of the receiving groove; a positioning block protruding from the free end so as to position a spanner installed to the driving portion 10 to prevent the spanner from sliding out;

the engaging portion having a hexagonal inner space for engaging with a screw object; the inner space of the engaging portion being communicated to the inner space of the driving portion so that a long tool can be inserted into the socket of the present invention.

* * * * *